United States Patent [19]

Fitch et al.

[11] Patent Number: 4,515,214

[45] Date of Patent: May 7, 1985

[54] METHOD FOR CONTROLLING THE VERTICAL GROWTH OF HYDRAULIC FRACTURES

[75] Inventors: John L. Fitch, Dallas; Malcolm K. Strubhar, Irving, both of Tex.

[73] Assignee: Mobil Oil Corporation, New York, N.Y.

[21] Appl. No.: 530,815

[22] Filed: Sep. 9, 1983

[51] Int. Cl.[3] ..... E21B 47/00; E21B 43/267

[52] U.S. Cl. ..... 166/250; 166/308

[58] Field of Search ..... 166/250, 259, 271, 308; 73/155

[56] References Cited

U.S. PATENT DOCUMENTS

| | | | |
|---|---|---|---|
| Re. 30,484 | 1/1981 | Broaddus et al. | 166/308 X |
| 3,167,124 | 1/1965 | Graham | 166/308 X |
| 3,858,658 | 1/1975 | Strubhar et al. | 166/308 |
| 3,918,524 | 11/1975 | Broaddus et al. | 166/308 X |
| 4,186,802 | 2/1980 | Perlman | 166/308 X |
| 4,434,848 | 3/1984 | Smith | 166/250 |
| 4,453,595 | 6/1984 | Lagus et al. | 166/308 X |

OTHER PUBLICATIONS

Clark, Jr. et al., "Let Geology Help Your Fracturing", *The Oil and Gas Journal*, Feb. 13, 1956, pp. 130–136.

*Primary Examiner*—George A. Suchfield

*Attorney, Agent, or Firm*—A. J. McKillop; Michael G. Gilman; George W. Hager, Jr.

[57] ABSTRACT

A method for controlling the vertical growth of hydraulic fractures in subterranean formations. The fracturing gradients of adjacent formations are determined. The fluid density necessary to inhibit the propagation of a hydraulic fracture from one adjacent formation into the other is determined from the fracturing gradients. A fracturing fluid is prepared having the necessary density for inhibiting such hydraulic fracture propagation.

18 Claims, 1 Drawing Figure

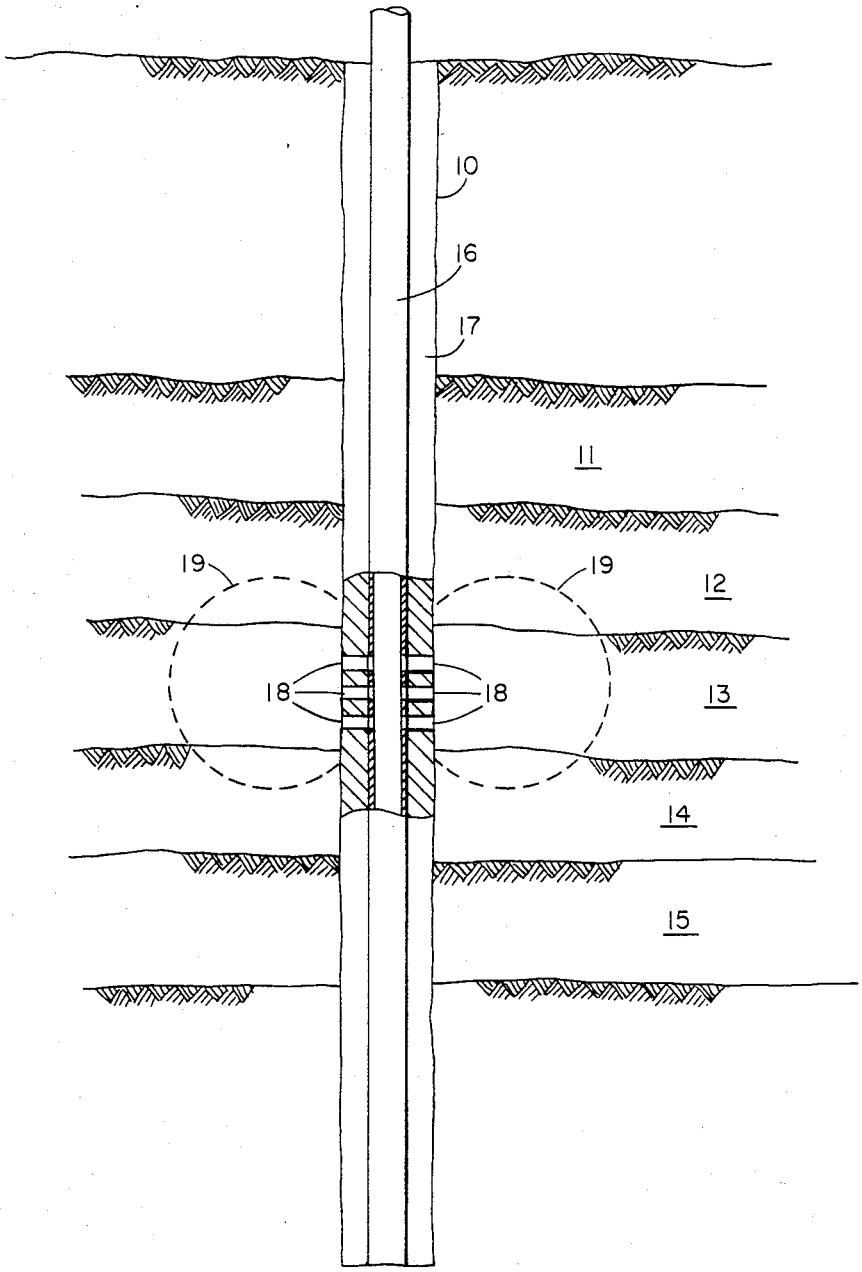
10
16
17
11
19
19
12
18
18
13
14
15

METHOD FOR CONTROLLING THE VERTICAL GROWTH OF HYDRAULIC FRACTURES

BACKGROUND OF THE INVENTION

This invention is directed to the method of hydraulically fracturing a subterranean formation. More specifically, this invention is directed to a method of forming vertically disposed fractures in a subterranean formation.

Hydraulic fracturing techniques have been extensively used for increasing the recovery of hydrocarbons from subterranean formations. These techniques involve injecting a fracturing fluid down a well and into contact with the subterranean formation to be fractured. Sufficiently high pressure is applied to the fracturing fluid to initiate and propagate a fracture into the subterranean formation. It is generally considered that at depth the fractures that are formed are vertical fractures. This is because at depth the least principal stress in most formations is in the horizontal plane which produces a preferred vertical fracture orientation. Proppant materials are generally entrained in the fracturing fluid and are deposited in the fracture to maintain the fracture open.

Hydraulic fracturing is widely practiced to increase the production rate from oil and gas wells. Fracturing treatments are usually performed soon after the formation interval to be produced is completed, that is, soon after fluid communication between the well and the reservoir interval is established for the purpose of production of injection. Wells are sometimes fractured for the purpose of stimulating production after significant depletion of the reservoir.

Hydraulic fracturing is the principal method used for stimulating production from oil and gas wells in low permeability reservoirs. Almost all of such fractures are vertical. It is always desirable, and sometimes necessary, to limit the vertical extent (height) of such fractures to the hydrocarbon-bearing zone of interest while extending the fracture for a substantial horizontal distance. Frequently, the desired horizontal extent (length) is many times the desired height. The desired result can be readily obtained when the interval to be fractured is bounded above and below by beds which inhibit the growth of fractures, such as soft shales. In many other cases the bounding beds are not effective in inhibiting the vertical growth of fractures. This is a major limitation of application of hydraulic fracturing technology. In such cases the resulting fracture grows into the non-productive bounding beds, and some of the valuable fracturing materials are wasted. In cases where permeable beds containing unwanted fluids, such as water, are also penetrated by the fracture a large amount of unwanted fluid is produced through the fracture into the producing well. In cases where the amount of such unwanted fluid is prohibitive, the well has to be abandoned.

SUMMARY OF THE INVENTION

The present invention is directed to a method for controlling the vertical growth of a hydraulic fracture in a subterranean formation located adjacent to another subterranean formation in which the propagation of the fracture is to be inhibited.

More particularly, fracturing gradients are determined for both the formation to be fractured and the adjacent formation where fracture propagation is to be inhibited. From these fracturing gradients there is calculated the fluid density necessary to prevent the fracture from propagating into the formation where fracturing is to be avoided, or the fluid density necessary to prevent penetration of the fracture into the adjacent formation more than a specified vertical distance. A fracturing fluid is then selected which has more than the minimum desired density if upward propagation is to be inhibited and less than the maximum desired density if downward propagation is to be inhibited, taking into account the amount of propping agent to be used in the fluid.

BRIEF DESCRIPTION OF THE DRAWING

The sole FIGURE illustrates a wellhead penetrating a plurality of subsurface formations, one of which is being fractured by the injection of fracturing fluid through perforations in the well casing adjacent such formation, the vertical growth of such fracture being controlled by the method of the present invention.

DESCRIPTION OF THE PREFERRED EMBODIMENT

Referring to the FIGURE, a well 10 extends from the surface of the earth into subsurface formations 11–15. The well 10 is equipped with casing 16 and is surrounded by cement 17 which prevents communication in the well outside the casing between the subsurface formations. Communication with a subsurface formation that is hydrocarbon bearing is established by perforations, such as perforations 18, into subsurface formation 13 for example. To enhance production from hydrocarbon bearing formation 13 a fracturing treatment is performed through the perforations 18, thereby producing the vertically disposed fracture 19.

It is a specific feature of the present invention to inhibit the growth of fracture 19 and prevent it from penetrating through non-permeable formations, such as 12 and 14, into permeable formations which contain unwanted fluids, such as 11 and 15. Fracture 19 is shown as tending to grow upward into formation 12. Since fracture growth is dominated by the magnitude of the least principal in-situ stress, the stress normal to the fracture plane in formation 12 is not much greater than is formation 13.

The least principal stress can be expressed as a fracturing gradient $g_f$, which is the least principal stress $S_h$ divided by the depth, that is:

$$g_f = S_h / Z \tag{1}$$

In order for the fracture to propagate, the fluid pressure in the fracture must exceed $S_h$. The fluid pressure in the fracture increases linearly with depth, depending on the fluid density, the total pressure at any point being $P_o + \rho gh$, where $P_o$ is the pressure at a reference point $Z_o$ in the fluid, $\rho$ is the fluid density, g is gravitational acceleration, and h is the vertical distance from the reference point $Z_o$, positive downward. Fluid pressure gradients due to vertical flow in the fracture have been neglected. In practice, it is convenient to express the fluid pressure gradient relative to the gradient $g_w$ in pure water, which is 0.43 pounds per square inch per foot (psi/ft). The gradient in any fluid is then 0.43 psi/ft $(\rho/\rho_o)$ where $\rho$ is the density of the fluid and $\rho_o$ the density of water, expressed in the same units. Thus, the fluid pressure $P_f$ in the fracture such as at 19 in the FIGURE is given by $$P_o+0.43(\rho/\rho_o)h. \quad (2)$$

The above information is now used to inhibit, i.e. minimize or negate, the tendency of fracture 19 to grow upward. This is best seen from the following example. Suppose the fracturing gradients $g_f$ of formation 13 and $g_f$ of formation 12 are determined to be 0.70 psi/ft. The fluid pressure in the fracture becomes:

$$P_f=P_o+0.43\ \rho/\rho_o(h) \quad (3)$$

Letting the reference point $Z_o$ be the bottom of formation 13, the fracture is propagated as follows:

$$P_o>g_fZ_o=0.70Z. \quad (4)$$

Letting the fracturing fluid be water, then the pressure at any point in the fracture $P_z$ is :

$$P_z=P_o+0.43(h)=P_o+0.43(Z-Z_o) \quad (5)$$

since h is positive downward the pressure $P_z$ is less than $P_o$. Thus, the pressure $P_{fz}$ to fracture at any point Z above $Z_o$ is:

$$P_{fz}>0.70Z=P_o-0.70[h] \quad (6)$$

where [h] is the absolute value of h. Thus, the fracture will have a strong tendency to propagate upward. In order to inhibit this tendency, we must use a fracturing fluid with a density such that:

$$(g_w)(\rho/\rho_o)>g_f \quad (7)$$

$$\rho > \frac{0.70\ (8.33\ ppg)}{0.43} > 13.56\ ppg \quad (8)$$

(*ppg* = pounds per gallon).

To provide a margin of safety, a fluid weighing 14 to 15 ppg should be selected.

From the above example, we see that fractures tend to grow upward for formations with equal fracture gradients which are in the normal range (0.60 to 0.90 psi/ft). Fracture gradients usually, but not always, increase with depth.

A case of downward fracture growth and means for inhibiting, i.e. minimizing or negating such growth will now be described for an example in which the fracturing gradient in formation 13 is 0.70 and the gradient in formation 14 is 0.69 psi/ft. The fracturing pressure at $Z_o$, the bottom of formation 13, is $0.70Z_o$. The fracturing pressure in bed 14 at any point $Z_o+h$ is:

$$P_z=0.69\ Z_o+0.69\ h. \quad (9)$$

Just below formation 13 the fracturing pressure in formation 14 is lower than in formation 13 by $0.70\ Z_o-0.69\ Z_o$ or $0.01\ Z_o$. Thus, the fracture will have a strong tendency to propagate into bed 14. In order to propagate the fracture in formation 13 without continuing to propagate downward in formation 14, $P_z$ must be:

$$P_z<0.70Z_o. \quad (10)$$

This requires:

$$0.70Z_o<0.69Z_o+0.69h \quad (11)$$

$$0.01Z_o<0.69h \quad (12)$$

If we let $Z_o=5000$ ft, we need $0.69h>50$ or $h>72.4$ ft. But we must also allow for the fracturing fluid head. This requires an additional $h,=\Delta h$, to balance the fluid head against the fracture gradient difference. This requires:

$$(g_w)(\rho/\rho_o)<g_f \quad (13)$$

$$0.43\rho/\rho_o(h+\Delta h)<0.69\Delta h \quad (14)$$

If the fracture penetrates 100 ft. into formation 14, then:

$$0.43\rho/\rho_o(100)<0.69(100-72.4) \quad (15)$$

and $$\rho/\rho_o<0.44 \quad (16)$$

The means available for adjusting $\rho/\rho_o$ are selection of fracturing fluids with different density, selection of different concentrations of propping agent, and selection of propping agents with different density. Any practical combination of fluid, proppant concentration, and proppant density may be used.

The means for determining the fracturing gradient include direct measures of the fracturing pressure and correlations such as these described in Breckels, I. M. and Van Eekelen, H. A. M., "Relationship Between Horizontal Stress and Depth in Sedimentary Basins," Journal of Petroleum Technology, September, 1982, pp. 2191–2199. Any other suitable means may be used.

The means of adjustment of fluid density will now be illustrated. In the forgoing example for an upward growing fracture it was seen that a fluid with density greater than 13.56 ppg is needed. This can be achieved by dissolving a suitable amount of sufficiently soluble and dense salt in water, along with gelling agents, etc., for example, sodium bromide. However, it will generally be more economical to achieve the desired density by adding a suitable amount of propping agent to the aqueous fluid. Part of the increase in density can be achieved, if desired, by dissolving inexpensive salts, such as sodium or calcium chloride, in aqueous fluid. In non-aqueous fluids, the same type of procedure can be followed.

The density of a fluid containing solids $\rho_{fs}$, such as propping agents, is given by:

$$\rho_{fs}=\rho_f(C_f)+\rho_s(C_s) \quad (17)$$

where $\rho_f$ is the fluid density, $C_f$ is the fraction of unit volume occupied by fluid, $\rho_s$ is the solid density and $C_s$ is the fraction of unit volume occupied by solid. The density of fracturing fluids and the concentration of solids contained therein is usually expressed in pounds per gallon, ppg:

$$ppg_{fs}=ppg_f(1-V_s)+\rho_s(V_s) \quad (18)$$

where $V_s$ is the fraction of proppant in the slurry. The volume of proppant in one gallon is:

$$V_s=ppg/\rho_s \quad (19)$$

where $\rho_s$ is the sand grain density in ppg=8.33 (2.65)=22.07. To obtain a water slurry density of 13.56 ppg we need:

$$13.56 = 8.33\,(1 - ppg/22.07) + ppg \quad (20)$$

$$= 8.33 - \frac{(8.33)(ppg)}{22.07} + ppg \quad (21)$$

$$= 8.33 + ppg\left(1 - \frac{8.33}{22.07}\right) \quad (22)$$

$$13.56 - 8.33 = ppg\ (0.6226) \quad (23)$$

$$ppg = 8.40 \quad (24)$$

If a larger increase in density is required than is obtainable by sand, a sintered bauxite or other agent may be used. If a still higher density is required, the density of the base fluid may be increased by addition of a soluble salt.

To obtain a less dense fracturing fluid a low density liquid, such as diesel oil, may be used. To obtain a still lower density, the aqueous or oil liquid may be mixed with a gas to obtain a stable foam, as is well known to those skilled in the art of hydraulic fracturing. The density of such foams, including propping agents if desired, is calculated in a manner similar to that given above for an aqueous slurry.

From the forgoing examples, it is seen that control of the vertical growth of fractures is exercised by control of the vertical pressure distribution within the fracturing fluid. If inhibition of upward fracture growth is desired, a dense fracturing fluid is used. If inhibition of downward fracture growth is desired, a light fracture fluid is used. More particularly the fracturing gradients in the formation to be fractured and in the adjacent formation where fracturing is to be inhibited are determined. From this there is determined the fluid density necessary to negate the propagation of the fracture into the formation where fracturing is to be avoided, or the fluid density necessary to minimize penetration of the fracture into the formation to no more than a specified vertical distance. A fracturing fluid is prepared which has more than the minimum density desired if upward propagation is to be inhibited or less than the maximum desired density if downward propagation is to be inhibited, taking into account the amount of propping agent to be used in the fracturing fluid.

Having now described the present invention in connection with a preferred embodiment, it is to be understood that various modifications and changes may be made without departing from the spirit and scope of the invention as set forth in the appended claims.

We claim:

1. A method of fracturing a subterranean formation that is located adjacent another formation in which fracturing is to be inhibited, comprising the steps of:

a. determining the fracturing gradient in the subterranean formation to be fractured, b. determining the fracturing gradient in the adjacent formation wherein fracturing is to be inhibited, c. determining from said fracturing gradients the fracturing fluid density necessary to inhibit the propagation of fracturing into said adjacent formation more than a specified vertical distance, d. selecting a fracturing fluid with the necessary density for inhibiting the propagation of said fracturing into said adjacent formation more than said specified vertical distance, and e. fracturing said subterranean formation with said fracturing fluid.

2. The method of claim 1 wherein said fracturing fluid is a dense fluid if inhibition of upward fracture growth is desired.

3. The method of claim 2 wherein the density of said fracturing fluid is increased by the addition of a granular solid propping agent.

4. The method of claim 2 wherein the density of said fracturing fluid is increased by the addition of sand.

5. The method of claim 2 wherein the density of said fracturing fluid is increased by the addition of a sintered bauxite.

6. The method of claim 2 wherein the density of said fracturing fluid is increased by the addition of a soluble salt.

7. The method of claim 1 wherein said fracturing fluid is a light fluid if inhibition of downward fracture growth is desired.

8. The method of claim 7 wherein the density of said fracturing fluid is descreased by the addition of a low density oil.

9. The method of claim 7 wherein the density of said fracturing fluid is decreased by the addition of a gas to obtain a stable foam.

10. The method of claim 1 wherein the density of said fracturing fluid is greater than the minimum fracturing fluid density required for upward fracture growth.

11. The method of claim 1 wherein the density of said fracturing fluid is less than the maximum fracturing fluid density required for downward fracture growth.

12. The method of claim 1 wherein the density of said fracturing fluid is increased by the addition of a propping agent with selected density.

13. The method of claim 1 wherein the density of the fracturing fluid is controlled by selectively adjusting the concentration of a propping agent added to said fluid.

14. The method of claim 1 further comprising the step of increasing the density of said selected fracturing fluid to inhibit the upward propagation of said fracture to less than said specified vertical distance.

15. The method of claim 1 further comprising the step of decreasing the density of said selected fracturing fluid to inhibit the downward propagation of said fracture to less than said specified vertical distance.

16. A method of selecting a fracturing fluid for use in a subterranean hydraulic fracturing operation, comprising the steps of:

a. determining the fracturing gradient of a selected subsurface formation to be fractured, b. determining the fracturing gradient in an adjacent subsurface formation, and c. utilizing said fracturing gradients to determine the density required for said fracturing fluid to inhibit fracture propagation from said selected subsurface formation into said adjacent subsurface formation during hydraulic fracturing operations.

17. The method of claim 16 wherein the fracturing fluid density is determined in accordance with the following to inhibit upward fracture growth:

$$\rho > (\rho_o)(g_f)/(g_w)$$

where:

$\rho$=density of fracturing fluid in pounds per gallon, $\rho_o$=density of water (8.33 pounds per gallon), $g_f$=fracturing pressure gradient (psi/ft.) of formation being fractured, $g_w$=fluid pressure gradient in pure water (0.43 psi/ft.).

18. The method of claim 16 wherein the fracturing fluid density is determined in accordance with the following to inhibit downward fracture growth:

$$\rho < (\rho_o)(g_f)/(g_w)$$

where:

$\rho$=density of fracturing fluid in pounds per gallon, $\rho_o$=density of water (8.33 pounds per gallon), $g_f$=fracturing pressure gradient (psi/ft.) of formation being fractured, $g_w$=fluid pressure gradient in pure water (0.43 psi/ft.).

* * * * *